United States Patent [19]

Kristen et al.

[11] 4,243,016

[45] Jan. 6, 1981

[54] VITREOUS CERAMIC COOKER HOB PLATE WITH PERMANENTLY ELASTICALLY ADHESIVELY ATTACHED CIRCUMFERENTIALLY SURROUNDING FRAME

[75] Inventors: Klaus Kristen, Wiesbaden; Herwig Scheidler, Finthen, both of Fed. Rep. of Germany

[73] Assignee: JENAer Glaswerk Schott & Gen., Fed. Rep. of Germany

[21] Appl. No.: 26,588

[22] Filed: Apr. 4, 1979

[30] Foreign Application Priority Data

Apr. 21, 1978 [DE] Fed. Rep. of Germany ... 7812144[U]

[51] Int. Cl.[3] ..... F24C 15/10; H05B 3/68

[52] U.S. Cl. ..... 126/211; 126/39 H; 219/464

[58] Field of Search ..... 219/464, 463, 459, 345; 4/173 A, 173 S, 170, 187 A; 126/39 H, 211, 214; 428/192, 81, 137

[56] References Cited

U.S. PATENT DOCUMENTS

| | | | |
|---|---|---|---|
| 3,169,158 | 2/1965 | Scott | 126/39 H |
| 3,423,770 | 1/1969 | Jensen | 4/170 |
| 3,446,201 | 5/1969 | More | 126/39 H |
| 3,567,906 | 3/1971 | Hurko | 219/464 |
| 3,679,870 | 7/1972 | Opp | 219/464 |
| 3,995,141 | 11/1976 | Vican | 219/464 |

FOREIGN PATENT DOCUMENTS

| | | | |
|---|---|---|---|
| 1474977 | 5/1977 | United Kingdom | 219/464 |

*Primary Examiner*—Samuel Scott
*Assistant Examiner*—G. Anderson
*Attorney, Agent, or Firm*—Hill, Van Santen, Steadman, Chiara & Simpson

[57] ABSTRACT

A vitreous ceramic cooker hob plate with circumferentially surrounding frame permanently elastically adhesively fitted thereto is provided. The circumferentially surrounding frame is adhesively joined to the hob plate in such a way that a narrow gap is left between the bevelled edge of the frame and the hob plate, and the frame flange overlaps the same. The gap is filled in, flush with the frontal side of the bevelled edge, by a permanently elastic adhesive which makes a sealed and mechanically firm joint between the bevelled edge and the hob plate.

8 Claims, 3 Drawing Figures

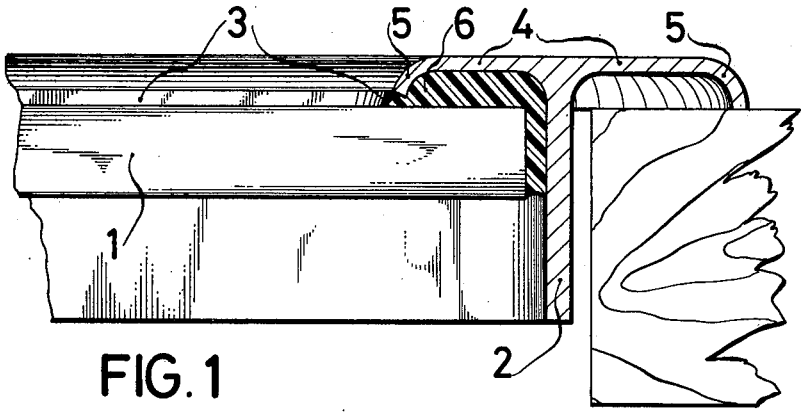
FIG. 1
FIG. 2
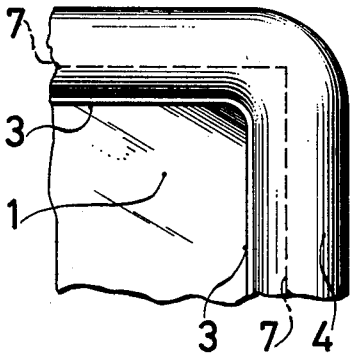
FIG. 3
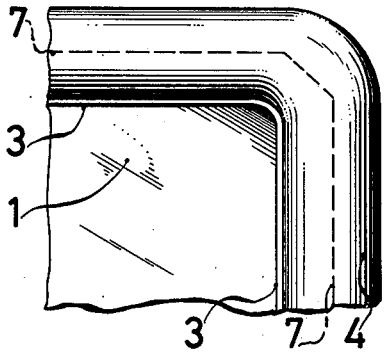

VITREOUS CERAMIC COOKER HOB PLATE WITH PERMANENTLY ELASTICALLY ADHESIVELY ATTACHED CIRCUMFERENTIALLY SURROUNDING FRAME

FIELD OF THE INVENTION

This invention relates to vitreous ceramic cooker hob plates with a permanently elastically adhesively attached circumferential frame surround of sheet metal or extruded profiles which comprise at least one flange which overlaps the hob plate surface. The hob plate is adhesively attached to the surrounding frame by means of a permanently elastic adhesive material in such a way that the adhesive material on the one hand absorbs all mechanical forces and provides a perfect seal between the hob plate and the hearth area while on the other hand, forming a gapless joint at the exposed edge of the frame profile resting on the hob plate.

BACKGROUND OF THE INVENTION

There are known vitreous ceramic hob plates with circumferentially surrounding frames which are mechanically clipped thereto, the hob plate being embraced along its outer circumferential edge by a silicon-rubber profile strip and the plate, thus provided with the sealing profile, being then screwed fast by mechanical means, such as, e.g., clamping screws, between an overlapping top frame and a base frame or clamping strips on the underside thereof. Such an arrangement presents certain drawbacks; one of these disadvantages is the large amount of material needed for the frame owing to the provision of the second, lower tension frame or the corresponding clamping strips, and the tension or clamping elements, such as springs, screws, clips and their holder means. Another disadvantage arises from the fact that, depending on details of construction of the frame, a great deal of time may be required for its assembly. Another serious technical drawback of this type of assembly resides in that by the very nature of the frame construction involved, it is not possible to preclude faulty assembly work which may result in damage to the hob plate itself. A typical case of this kind is, for example, the fracture of the hob plate caused by localized excessive tensions arising from irregular application of the lower tension frame to the underside of the hob plate.

As far as practical usefulness is concerned, another vital disadvantage resides in that the comparatively thin profiles of the top frame apply clamping tension to the hob plate chiefly along the extreme outer edge regions thereof whereas the overlapping frame part cannot be really firmly pressed against the sealing profile and the hob plate itself. This means that is is impossible to obtain a secure and reliable frame seal. Furthermore, the inner frame edge which rests on the surface of the hob plate also tends to gape slightly in the vertical direction, and because, for reasons of manufacturing tolerances, the leading edge of the silicon rubber profile does not finish perfectly flush with the edge of the overlapping top frame section, dirt which tends to collect in these gaps between frame and hob plate can no longer be completely removed by the user of the appliance. Furthermore, such dirt is liable to swell up and this may give rise to locally higher clamping stresses or tensions which may even lead to fracture of the hob plate.

German Gebrauchsmutern specifications, Nos. 7 401 645 and 7 406 776 describe cooker hob plates which are adhesively fitted in their circumferentially surrounding frames by means of a permanently elastic adhesive material. However, a common feature in these arrangements, and also in all types derived therefrom, is that the circumferentially continuous surround profile does not actually overlap the hob plate surface and for preference the hob plate is adhesively fixed by its underside to an interior fold or flange strip formed by bending, flanging, wrinkling or similar methods or part of the extruded profile, and the top side of the hob plate is either flush with, i.e., in the same plane as the visibly exposed edge of the frame profile or extends from about 1 to 2 mm beneath the exposed frame edge. The gap thus created all around the hob plate between the latter and the frame surround is here filled in with a permanently elastic sealant. While this latter type of arrangement, wherein the hob plates are adhesively fitted in their surrounding frames from the top side thereof, is clearly superior in respect of mechanical tension and stress conditions to the clamped or clip-fitted assemblies and also easier to clean by the user of the appliance, there are still a number of drawbacks regarding manufacture, appearance and choice of design. In the manufacture of this type of hot plate assembly very close tolerances must be observed with regard to the parallelity of the sides of the vitreous ceramic hob plates and to their angularity as well as with regard to the cooperating frame edges. Consequently, expensive and complicated treatment and adhesive fixing technology are required for making the vitreous ceramic hob plates and also expensive production methods for making the surrounding frames. The adhesive fixation method here adopted demands the precise centering of the hob plate in its surrounding frame, since even minor deviations in the parallelity of mutually opposite edges of frame and hob plate will be noticed at a glance and mar the overall appearance of the assembly.

Another drawback of this type of adhesive technique resides in that when using the suitable, conventionally available adhesives which are sufficiently resistant to the thermal loads liable to be applied thereto, there is of necessity a closely restricted choice with regard to the frame materials which may be used in conjunction with such adhesives since there are only a few metals which will form an adequately firm and secure, heat-and food-resisting bond with these adhesives. Furthermore, since the adhesive joint is in the same plane as the hob plate surface, the color of the adhesive material must be matched to the color of the hob plate itself. This imposes considerable limits on design because suitable permanently elastic and heat-stable adhesives which afford an unlimited choice of color are not yet commercially available.

BRIEF SUMMARY OF THE INVENTION

It is the aim of the present invention to provide a vitreous ceramic hob plate of the kind comprising a circumferentially surrounding frame which is adhesively bonded thereto in permanently elastic manner, which is not afflicted by the above described disadvantages and, in particular, which does not impose any restrictions in the choice of frame materials, and wherein the dimensional tolerances of the vitreous ceramic plate can be considerably wider than those which would be acceptable for the earlier described type of adhesively mounted hob plates while further affording a wider choice with regard to the adhesive material itself.

The vitreous ceramic hob plate with adhesively attached circumferentially surrounding frame according to this invention, which is hereinafter more specifically described, achieves this aim thanks to the fact that the adhesive joint with the frame is on the top side of the hob plate and that, except for a narrow visually exposed edge, this adhesive joint is concealed by an appropriately designed overlapping flange or similar part of the frame. Thanks to these provisions, even major dimensional tolerances in the vitreous ceramic hob plate will not matter at all provided there is sufficient overlap of the frame. The desired freedom of choice with regard to the adhesive material itself arises from the fact that in this arrangement, as described below, the adhesive material as such will be visible only in a very narrow circumferential region of the edge of the frame which sits on the hob plate. With regard to the selection of frame materials, there is a considerably wider freedom of choice owing to the fact that the overlapping frame will securely hold and engage with the hob plate even under major mechanical loads and, consequently, the adhesive joint as such is relieved of such loads, while, furthermore, the frame may be coated with a metal which is compatible with the adhesive material and this intermediate coating layer will ensure perfect bonding between frame and adhesive. This opens up the possibility, for example, of making the frame surrounds of plastic materials, which while being basically well suited for such application, could not hitherto be used for this purpose, but which can now be satisfactory adhesively bonded by means of the metallized coating thereon.

The provision of a defined narrow visibly exposed edge between frame and hob plate results in the advantage of easy cleaning, as in the earlier described adhesively mounted assemblies, and dirt-collecting gaps or edges of the kind liable to occur in the clamped assemblies are reliably precluded. The arrangement further has the special advantage of lending itself eminently well to frame designs with rounded, or so-called "soft-line" corners, which can now be readily executed without requiring expensive machining of the vitreous ceramic material of the hob plate.

BRIEF DESCRIPTION OF THE DRAWINGS

The invention is hereinafter more specifically described by way of example with reference to one preferred embodiment thereof concerning a vitreous ceramic cooker hob plate with adhesively attached circumferential frame surround as illustrated in FIGS. 1, 2 and 3 of the accompanying drawings, wherein:

FIG. 1 is a fragmentary sectional view of the arrangement according to this invention; and FIGS. 2 and 3 are fragmentary plan views viewed from the top of part of the arrangement according to this invention.

For convenience and ready reference, the following reference numerals designate the following parts:

FIG. 1:

1. vitreous ceramic cooker hob plate,
2. vertical flange of frame profile,
3. visibly exposed edge between frame and hob plate,
4. overlapping flange of frame profile,
5. bevelled or chamfered edge of upper frame flange,
6. permanently elastic adhesive.

FIG. 2:

1. vitreous ceramic cooker hob plate,
7. edge of vitreous ceramic hob plate,
4. overlapping flange of frame profile,
3. visibly exposed edge.

FIG. 3:

1. vitreous ceramic hob plate,
7. edge of vitreous ceramic hob plate,
4. overlapping flange of frame profile,
3. visibly exposed edge.

DESCRIPTION OF THE PREFERRED EMBODIMENTS

The frame profile shown in FIG. 1, e.g., an (anodized) extruded profile of aluminum or plastics material, or a sheet metal profile of enamelled steel, comprises a vertical flange 2 and a further, in this case, horizontal flange 4 with the bevelled or chamfered edges 5. If a frame made from this or an equivalent profile material is placed on top of the vitreous ceramic hob plate surface 1, a circumferentially continuous narrow and open, visibly exposed edge 3 would be created between the frame edges 5 and the hob plate surface 1 owing to planarity deviations in the hob plate 1 and vertical tolerances in the frame edging 5.

This, open, exposed edge or gap is sealed and smoothed over by injecting the adhesive material 6 into the open gap with the aid of a suitable gauge or template. At the same time, enough adhesive material is injected between the frame profile and the hob plate to ensure that the vitreous ceramic plate 1 is adhesively bonded to the horizontal flange 4 as well as, along its narrow sides, to the vertical flange 2 of the frame profile.

Conveniently, the width of the open, exposed edge gap is adjusted by means of the gauge or template to a value between 3/10 and maximally 1 mm, in order to make sure that the subsequently hard-setting, but permanently elastic adhesive material will prevent the frame edges from being pressed hard against the hob plate surface 1 under major bending or impact loads in the marginal region of the hob plate. This will prevent potential damage to the hob plate 1 in its marginal region by the frame edges 5. The narrow visible edging 3 enhances the visual appearance and, at the same time, enables perfect cleaning. There are no dirt collecting gaps or edges of the kind occurring with clamped or similarly mechanically fixed frame assemblies. A special advantage arising from this type of adhesive mounting resides in that it permits without significantly higher costs, the execution of hob plate assemblies with rounded frame corners, i.e., of the so-called soft-line type, as shown in FIGS. 2 and 3, applied to angularly cut hob plates. With arrangements of the kind described in German Gebrauchsmutern specifications Nos. 7 401 645 and 7 406 776 this can only be achieved with a considerable production outlay and correspondingly high costs, owing to tolerances.

It will be apparent to those skilled in the art that many modifications and variations may be effected without departing from the spirit and scope of the novel concepts of the present invention.

We claim as our invention:

1. A vitreous ceramic cooker hob plate having a circumferentially surrounding frame permanently elastically adhesively fitted thereto, said frame being generally of T-shaped cross-section having an inwardly extending flange portion overlapping, but slightly spaced from the upper marginal surface portion of said ceramic plate, another portion of said frame extending downwardly past the outer edge of said ceramic plate but slightly spaced therefrom, and a permanently elastic adhesive filling the spaces between said frame and said ceramic plate, said permanently elastic adhesive making a sealed and firm joint between said frame and said hob plate.

2. A vitreous ceramic cooker hob plate according to claim 1, in which the inner edge of said inwardly extending flange of said frame being bevelled.

3. A vitreous ceramic cooker hob plate according to claim 1, in which the inner edge of said inwardly extending flange of said frame being downwardly turned but terminating short of the surface of said hob plate.

4. A vitreous ceramic cooker hob plate according to claim 1 or 2, in which said frame has rounded corners while said hob plate is cut with angular corners.

5. A vitreous ceramic cooker hob plate according to claim 1, in which the outwardly extending flange portion of said T-shaped frame member acts as a support for said hob plate when it is desirable to support said hob plate on a shelf.

6. A vitreous ceramic hob plate having a circumferentially surrounding frame permanently elastically adhesively fitted thereto, said frame having an inwardly extending flange extending over a marginal surface portion of said hob plate but spaced therefrom and a downwardly extending flange portion extending opposite the edge portion of said hob plate but spaced therefrom, and a permanently elastic adhesive filling the space between said inwardly extending flange of said frame and said hob plate and between said downwardly extending flange of said frame and the outer edge of said hob plate, said permanently elastic adhesive making a sealed and permanent joint between said frame and said hob plate.

7. A vitreous ceramic hob plate according to claim 6, in which said inwardly extending flange of said frame extends downwardly toward said hob plate but terminating short thereof.

8. A vitreous ceramic hob plate according to claim 7, in which the downwardly turned portion of said inwardly extending flange of said frame and the edge of said adhesive provide a smooth inwardly facing edge portion.

* * * * *